US006345476B1

(12) United States Patent
Hill

(10) Patent No.: US 6,345,476 B1
(45) Date of Patent: Feb. 12, 2002

(54) PERFORATED PLEATED SHUTTER AND METHOD

(76) Inventor: George A. Hill, 13800 Alexandria Ct., Davie, FL (US) 33325

( * ) Notice: Subject to any disclaimer, the term of this patent is extended or adjusted under 35 U.S.C. 154(b) by 0 days.

(21) Appl. No.: 09/292,255

(22) Filed: Apr. 15, 1999

Related U.S. Application Data

(63) Continuation-in-part of application No. 08/966,045, filed on Nov. 7, 1997, now Pat. No. 5,996,292, which is a continuation of application No. 08/723,893, filed on Oct. 1, 1996, now abandoned, which is a continuation-in-part of application No. 08/541,393, filed on Oct. 10, 1995, now Pat. No. 5,596,849, which is a continuation-in-part of application No. 08/344,222, filed on Nov. 23, 1994, now Pat. No. 5,487,244.

(51) Int. Cl.[7] ..... E06B 3/26

(52) U.S. Cl. ..... 52/202; 52/588.1; 52/630; 49/67; 160/118; 160/187; 160/199; 160/235

(58) Field of Search ..... 52/202, 203, 579, 52/783.12, 703.15, 784.1, 508.1, 630; 49/57, 61, 62, 67, 464; 160/118, 185, 187, 196.1, 199, 201, 206, 235, 236, 229.1

(56) References Cited

U.S. PATENT DOCUMENTS 3,020,951 A * 2/1962 Graulich
5,345,716 A * 9/1994 Caplan ..... 49/61
5,426,893 A 6/1995 Hoffman
5,457,921 A 10/1995 Kostrzecha
5,472,037 A * 12/1995 Hoffman ..... 160/183
5,487,244 A 1/1996 Hill
5,570,542 A 11/1996 Cameron
5,595,233 A * 1/1997 Gower ..... 160/232
5,596,849 A 1/1997 Hill
5,651,221 A * 7/1997 Golen ..... 52/202
5,927,028 A * 7/1999 Rossi ..... 52/202
5,941,031 A * 8/1999 Fullwood ..... 52/202
5,950,384 A * 9/1999 Aarness ..... 52/473
6,079,168 A * 6/2000 Shaver ..... 52/202

* cited by examiner

*Primary Examiner*—Yvonne M. Horton
(74) *Attorney, Agent, or Firm*—Jack E. Dominik

(57) ABSTRACT

A pleated panel shutter system for an opening in a dwelling in which the pleated panel portions can be drawn to the side rendering the bulk of the opening available for ventilation, light, and the normal function of a window or a door. The pleated panel can be closed shut, and optionally locked, with securement against vandalism as well as high winds and flying debris damage, such as occurring in a hurricane. The strength of the pleated panels in the vertical orientation permits perforation over more than 50% of the surface of each of the panels, while still providing ample impact against winds up to 125 mph., and survive the impact test of a two by four (2×4) six (6) feet long fired at 34 mph. without deflecting more than 2½ inches.

7 Claims, 6 Drawing Sheets

PERFORATED PLEATED SHUTTER AND METHOD

RELATED APPLICATIONS

This Application is a Continuation-in-Part of application Ser. No. 08/966,045, filed Nov. 7, 1997 now U.S. Pat. No. 5,996,292; which is a Continuation of application Ser. No. 08/723,893, filed Oct. 1, 1996, now abandoned; which is a Continuation-In-Part of application Ser. No. 08/541,393, filed Oct. 10, 1995, now U.S. Pat. No. 5,596,849, issued Jan. 28, 1997; which is a Continuation-In-Part of application Ser. No. 08/344,222, filed Nov. 23, 1994, now U.S. Pat. No. 5,487,244, issued Jan. 30, 1996.

FIELD OF THE INVENTION

The present invention is directed to a shutter system for openings generally in a dwelling. More specifically, a shutter system is involved in which vertical panels are pleated and blended centrally for securement to totally cover the opening in the dwelling, or opened laterally, like the curtain on a stage, for securement at the opposed lateral sides of the opening. Primarily the system will be used on window systems, but it is also, in a larger form, applicable to doors, particularly of the sliding glass variety which prevail in areas which are susceptible to hurricanes and high winds.

BACKGROUND OF THE INVENTION

The prior art is illustrated primarily in Applicant's application Ser. No. 08/344,222, filed Nov. 23, 1994, now U.S. Pat. No. 5,487,244, issued Jan. 30, 1996; Continuation-In-Part application Ser. No. 08/541,393, filed Oct. 10, 1995, now U.S. Pat. No. 5,596,849, issued Jan. 28, 1997; Continuation-In-Part application Ser. No. 08/723,893, filed Oct. 1, 1996, now abandoned; and co-pending Continuation application Ser. No. 08/966,045, filed Nov. 7, 1997 of which this application is a Continuation-In-Part. There a system is shown of hurricane shutters having vertical panels which are removably secured to cover an opening generally in a dwelling. Each of the panels must be separately secured with independent fastening means in overlapping relationship. While the panels may be secured directly to the wall of a building, they can also be slipped upwardly into a header, then lowered and mounted on a footer, or just directly to the wall of the dwelling. Such panels are perforated, but because they are ribbed, the perforations cannot cover the entirety of each of the shutter panels. Moreover, they cannot be readily opened and closed, nor locked in the closed position against removal.

SUMMARY OF THE INVENTION

In view of the foregoing it is a principal objective of the present invention to provide a pleated panel shutter system for an opening in a dwelling in which the pleated panel portions can be drawn to the side rendering the bulk of the opening available for ventilation, light, and the normal function of a window or a door. Alternatively, the pleated panel can be closed shut, and optionally locked, with securement against vandalism as well as high winds and flying debris damage, such as occurring in a hurricane. However, despite the totality of the enclosure the strength of the pleated panels in the vertical orientation permits perforation over more than 50% of the surface of each of the panels, while still providing ample impact against winds up to 125 mph., and survive the impact test of a two by four (2×4) six (6) feet long fired at 34 mph. without deflecting more than 2½inches.

In view of the foregoing it is a principal object of the present invention to provide a perforated pleated panel system for protecting an opening, generally in a dwelling, from winds and flying debris while at the same time permitting both ventilation and light to pass through, conversely, permitting the person inside the dwelling to look through the perforated panels and be aware of the scene on the outside.

A further object of the present invention is to provide such a panel system which while permitting all of the above advantages and objective to be achieved, is economical to fabricate and install competitively with other panels not affording the advantages of the present invention.

DESCRIPTION OF THE DRAWINGS

The subject invention will be better understood taken in conjunction with the accompanying illustrative drawings of an illustrative embodiment, in which.

DESCRIPTION OF A PREFERRED EMBODIMENT

Figure 1:
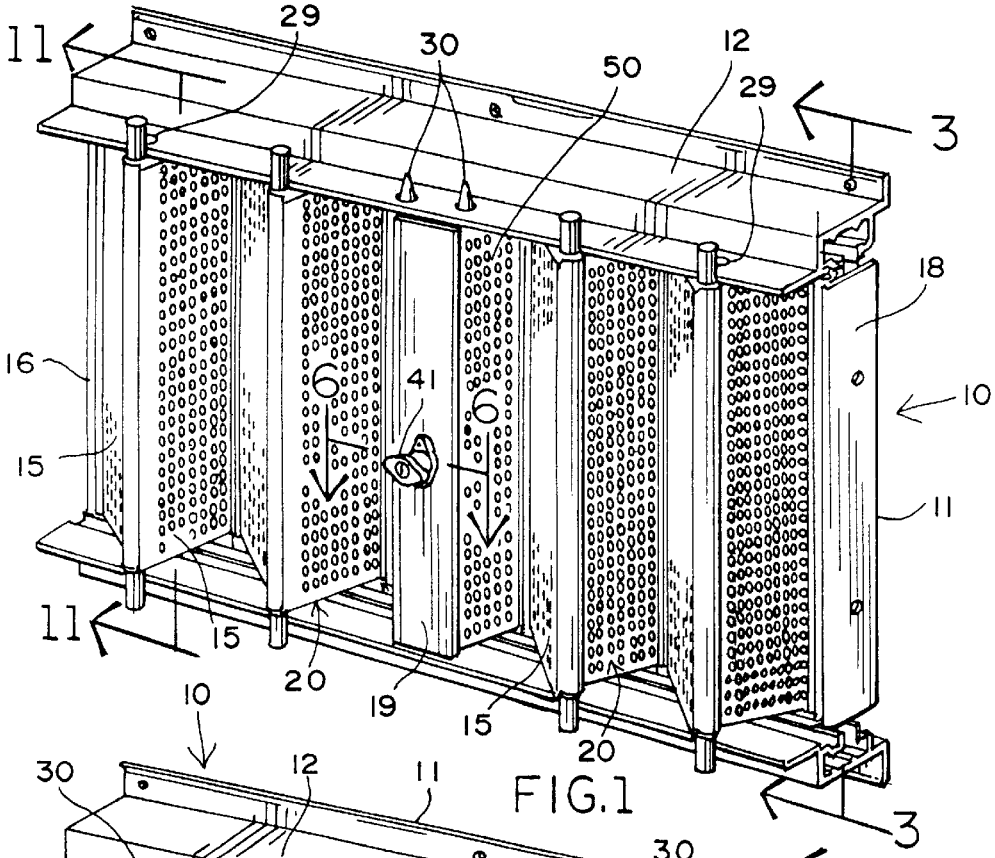
FIG. 1 is a perspective view of the illustrative pleated shutter system showing the header, the footer, and the end plates, the same being in the closed and locked configuration.
Figure 2:
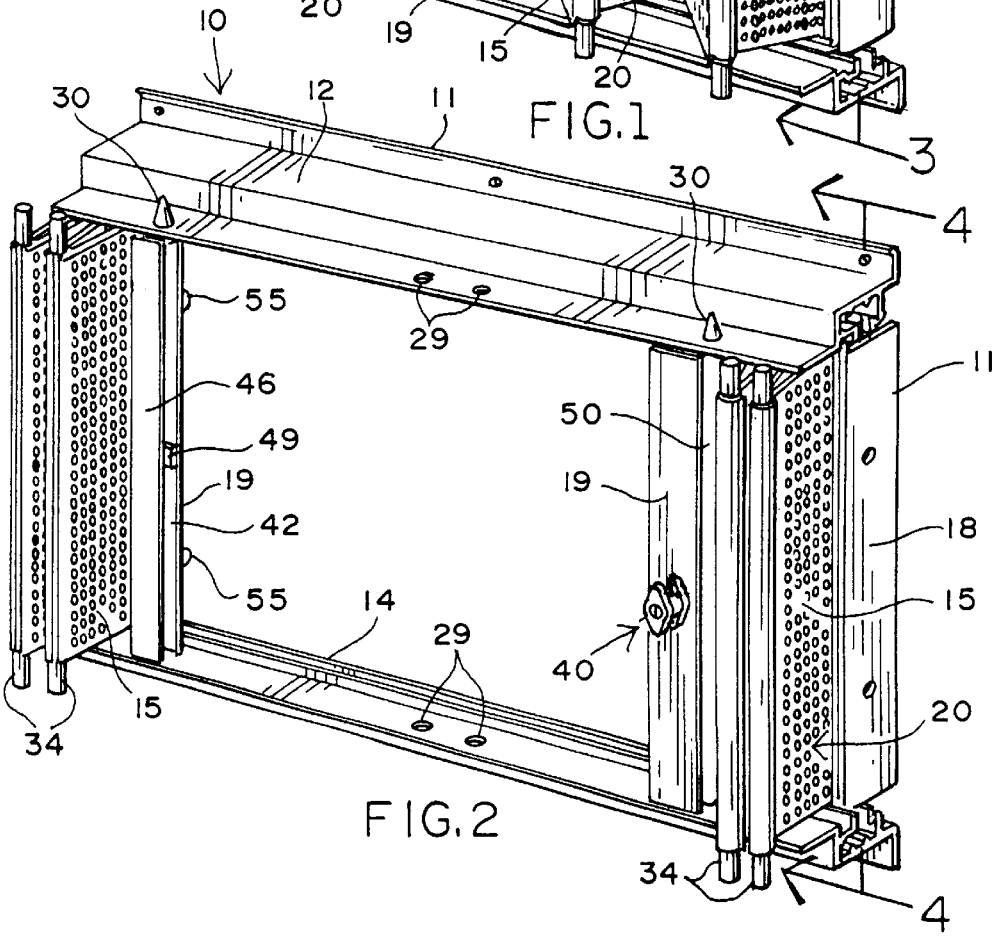
FIG. 2 is taken substantially in the same scale of FIG. 1 but showing the pleated panels of the shutter in the open position.
Figure 6:
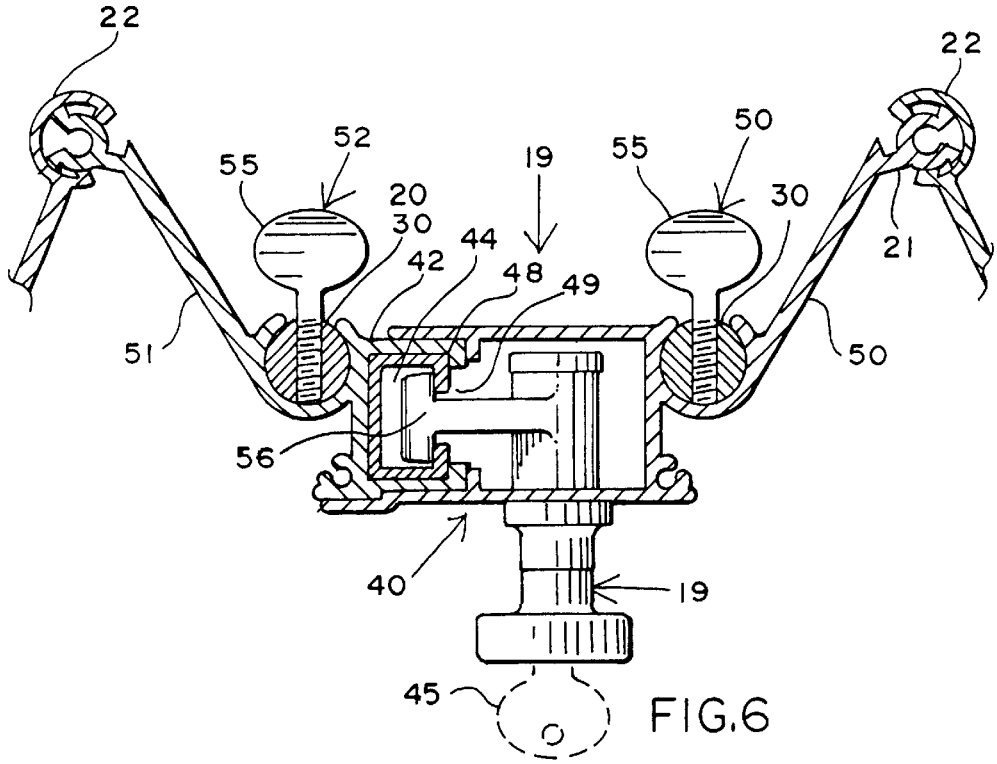
FIG. 6 is a transverse sectional view, partially broken, taken along section line 6—6 of FIG. 1 through the locking assembly.

The pleated shutter system 10 is shown in FIG. 1 and 2. In FIG. 1 it is shown closed covering the opening in a dwelling. In FIG. 2 it is shown open, to open the access to the dwelling where the shutter is installed. In both instances the pleated shutter system 10 includes an outer frame 11. The outer frame 11 is made up of a header 12, a footer 14, a plurality of pleated panels 15, a left end plate 16, and a right end plate 18. A center lock assembly 19 is provided as shown in FIG. 1. The center lock assembly 19, in turn, utilizes a latch lock assembly vertical member 40, said latch lock assembly having a handle 41, and the same mounting into a latch catch assembly 46. The same is secured in place by engaging the latch 56 as best illustrated in FIG. 6, where the latch slot 49 permits the latch member to enter and secure interiorly of the latch track 44. Further, as to FIG. 6, it will be seen that the latch mount assembly 42 includes an interior latch track 44, a latch track liner 48, and a key 45 for turning the center lock assembly 19 thereby removing the latch from the latch slot 49.

Figure 8:
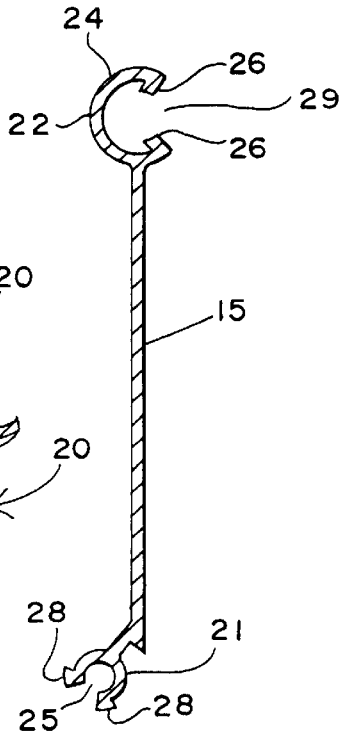
FIG. 8 an enlarged transverse view of a typical panel.

Turning now to FIG. 8 it will be seen that each panel 15 has an inner panel knuckle 21, and an outer panel knuckle 22. Each knuckle, in turn, has a jaw denoted as outer jaw 24 and inner jaw 25. In addition, there are outer jaw stops 26, and inner jaw stops 28 which restrict the angle of rotation of the joint assembly of the inner panel knuckle 21 and outer panel knuckle 22. Immediately adjacent FIG. 8, on FIG. 9, there is a perspective view of the lock pin 30 which includes the lock pin set 52, its threaded shaft 54, and thumb grip 55.

Figure 5:
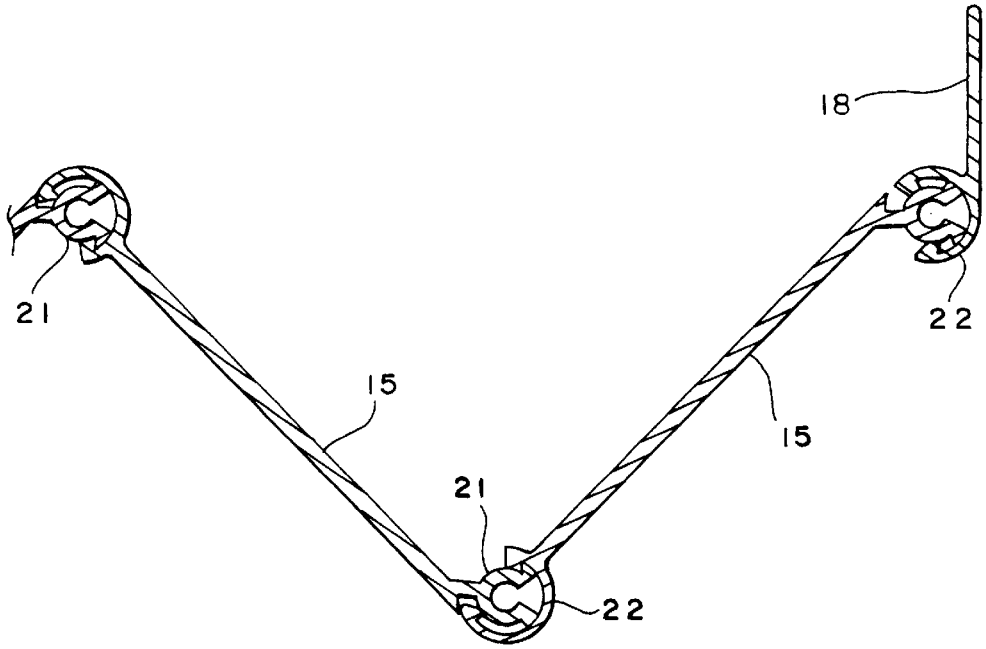
FIG. 5 is a transverse sectional view of the pleated members taken along section line 5—5 (in part of FIG. 1) and showing how the panels interlock with each other.

To be noted in FIG. 5 is the relationship between the adjacent panels 15 and the lock panel end plate portion 18 of the end plate on the right-hand side. The panels 15, as will be seen, each have a panel inner knuckle 21 and a panel outer knuckle 22. The same are proportioned so that the inner knuckle 21 slidably engages the outer knuckle 22 as shown in the bottom portion of FIG. 5.

Figure 3:
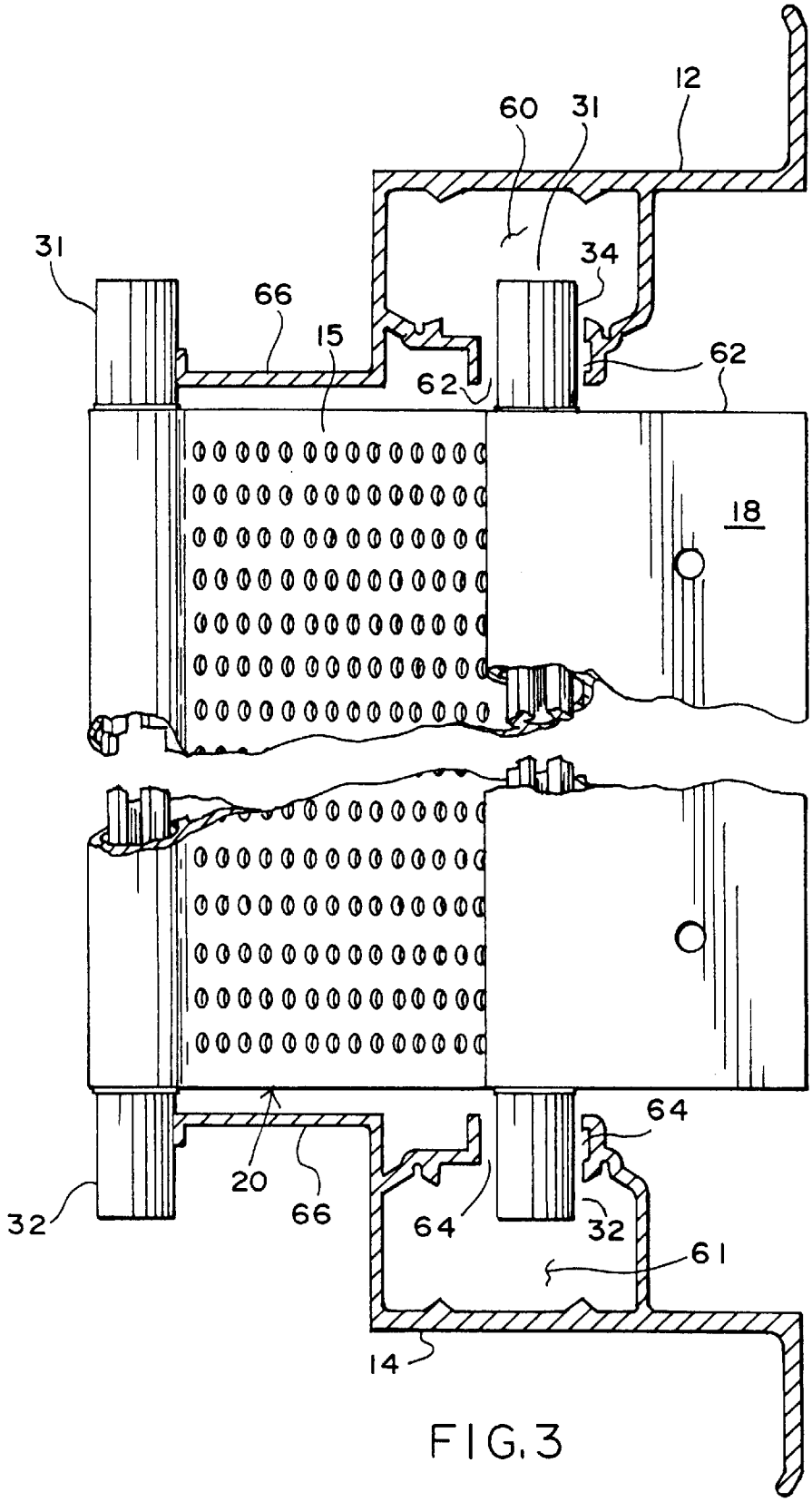
FIG. 3 is an enlarged, broken, cross-sectional view of the panel assembly of FIG. 1 taken along section line 3—3 of FIG. 1.
Figure 7:
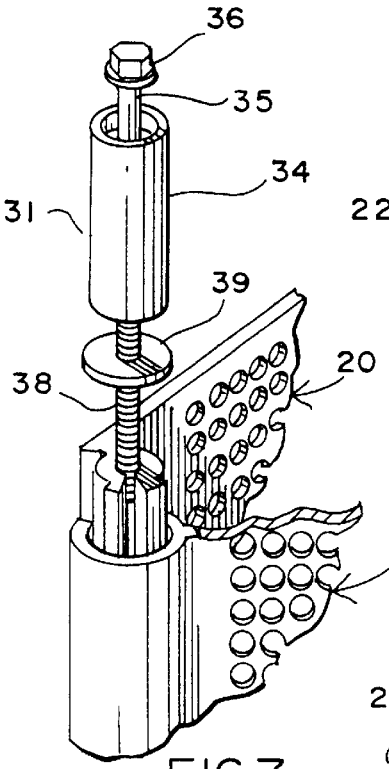
FIG. 7 is an enlarged partially prospective broken view of the upper edge of two adjacent panels showing how the roller assembly is secured to the pleated panels.

Turning now to FIG. 3, it will be seen that the panel knuckles 21, 22 have an upper roller assembly 31 at the top, and a lower roller assembly 32. Each of the rollers 34, particularly as illustrated in FIG. 7, is secured by means of a roller shaft bolt 35, which has a bolt head 36, and a threaded shaft 38. The same is screwed in the interior opening in the small inner knuckle 21, the subject holes are identified as reference 29, and as will be seen are provided in the bottom as well as the top of FIG. 2, but also the holes are provided at the laterally spaced positions, as identified in FIG. 1, where the pins secure the shutter in the open position as illustrated in FIG. 2. For further detail of the upper roller assembly, note should be given to FIG. 7 where, as shown, a washer 39 separates the upper roller assembly 31, 34 from the upper portion of the panel joint. In addition, noting FIGS. 3 and 4, it will be seen that there is an upper roller channel 60 in the header 12,and a lower roller channel 61 in the footer 14. Moreover, there is an upper roller track 62 provided by two opposed members enclosing the upper roller channel 60, and similarly a track 64 defined above the lower roller channel 61.

Figure 4:
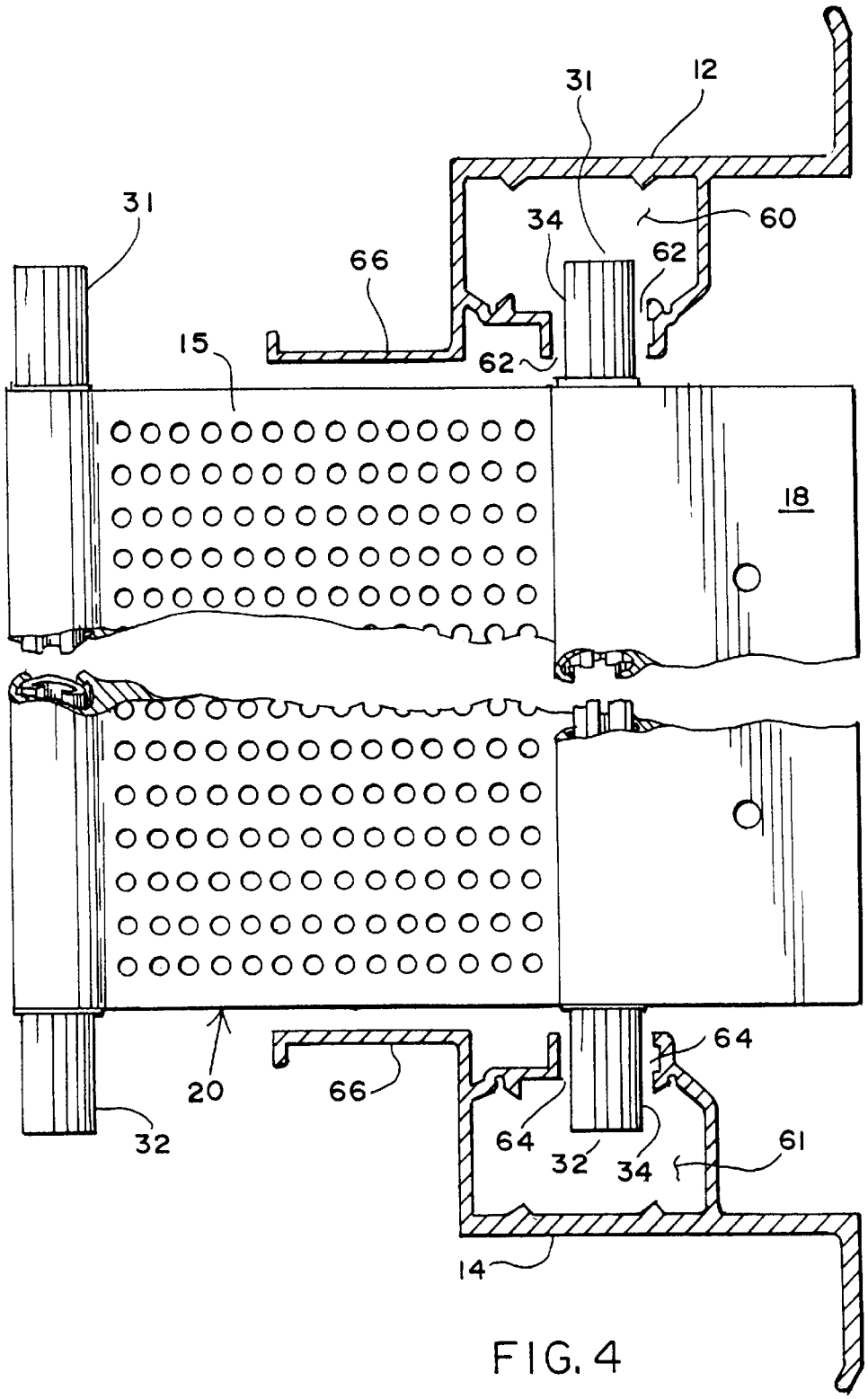
FIG. 4 is a view comparable to that of FIG. 3, but taken along section line 4—4 of FIG. 2 in showing the pleated shutter assembly in the open condition.

The perforations, as best illustrated in FIGS. 3 and 4, are ideally of ⅛ inch diameter on ¼ inch spacing. The spacing approaches the top and bottom edges of the panel 15 spaced at slightly more than ¼ inch, and the same is true as it approaches the inner knuckle 21 and the outer knuckle 22. Because the panel 15 is flat, the perforation can be ideally set forth in a density which is uniform throughout the frontal area of the panel 15, as distinguished from ribbed shutter panels where the bending of the ribs in the manufacturing process inhibits the utilization of a blank which is perforated uniformly over substantially its entire surface, as illustrated in FIGS. 3 and 4. Despite the increased amount of perforation, because of the pleated nature of the panels 15 in the operable position as shown in FIG. 3, the strength advantages achieved through pleating offset the weaknesses induced by the perforations. On the other hand, because of the increased use of the perforations, the cost of perforating is virtually paid for by the scrap which is punched out of the panel. Moreover, the view from the interior portion of the dwelling resembles twilight or the presence of an overcast, as distinguished from an interrupted view. In addition, all of the panels 15 are perforated in substantially the same fashion thereby eliminating a scalloping or streaking effect in the visibility from the interior portion of the dwelling when scanning from left to right, as well as from up and down. A comparable effect occurs in ventilation which is substantially uniform across the shutter system 10 when closed, where the protected window or door is open.

The method of the present invention is derived by developing a frame assembly 11 for a pleated shutter system having a header 12 and footer 14. Means are provided for linking the panels together. The method comprises the steps of a slidably engaging the panels 15 each to the other by inserting the inner knuckle 21 into the outer knuckle 22, and thereafter securing the rollers by way of the upper roller assembly 31 and the lower roller assembly 32 at the joint between the adjacent panels to therefore secure the panels together for opening and closing. An important portion of the invention is derived from perforating the subject panels 15 with a perforated pattern 20 which uniformly covers substantially the entire surface of each pleated panel 15.

Figure 9:
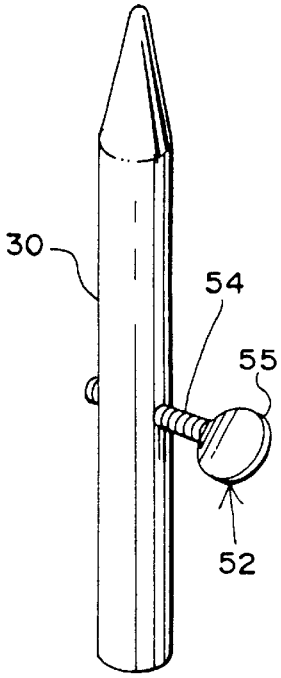
FIG. 9 is a perspective view of the upper portion of a lock pin.
Figure 10:
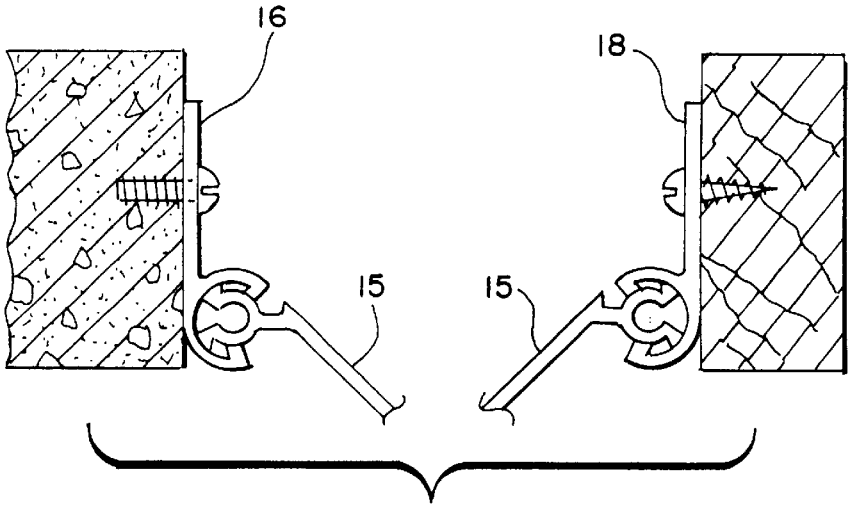
FIG. 10 is a broken transverse sectional view showing the left and right end plates and the means for securing the end plates to the operating panels.
Figure 11:
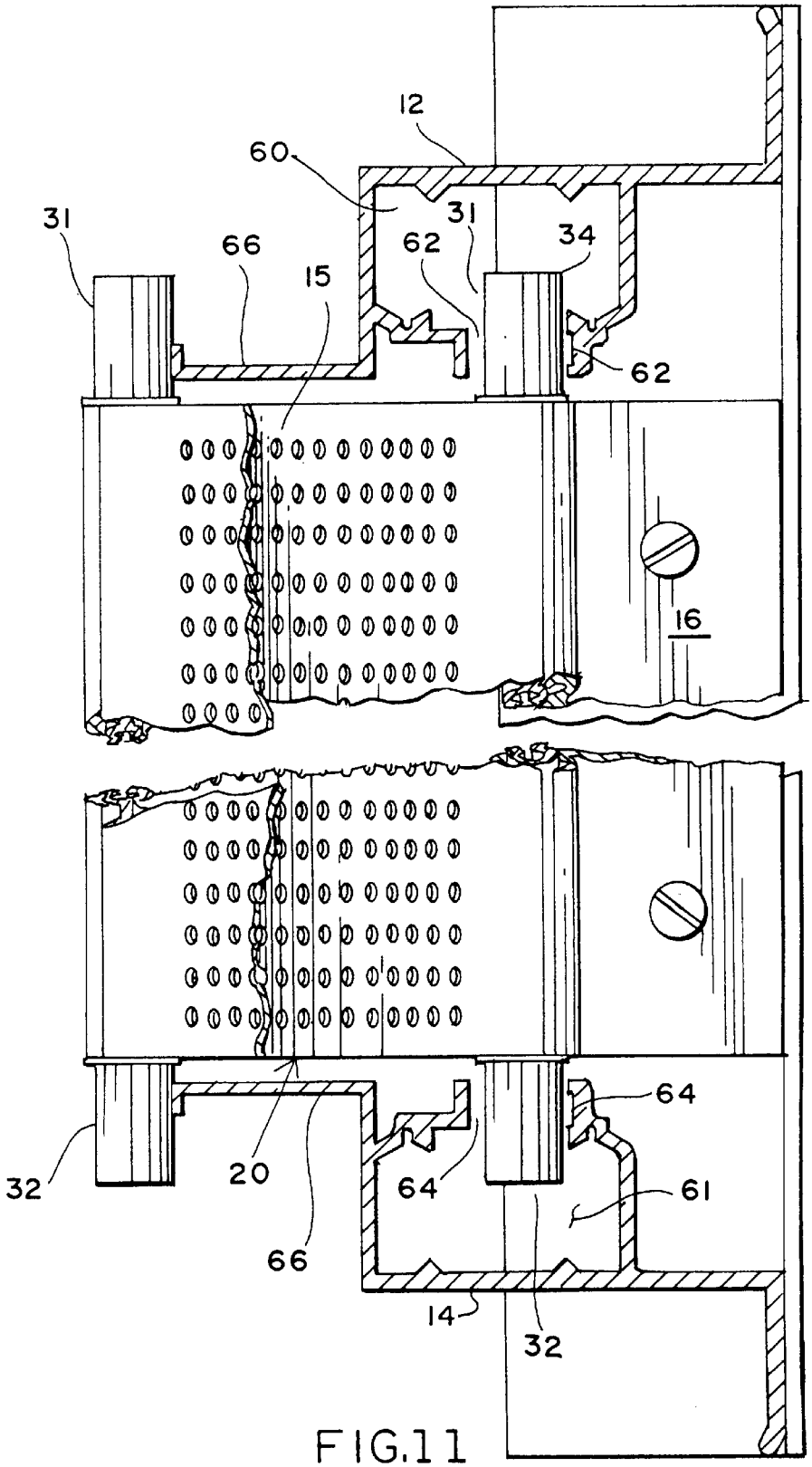
FIG. 11 is a view comparable to FIGS. 3 and 4, but showing a panel in broken form, and more detail with regard to the securement of the end plates to the wall structure in the building.

The lateral end plates 16 and 18 are best shown in FIG. 9. There will be seen that just like the latch assembly as shown in FIG. 6 where there are catch panel mounts 50 and 51, there are panel mounts 66 and 68 extending from respective left end plate 16 and right end plate 18. The method further includes the securement of the frame over an opening in a dwelling or other building structure after the same has been proportioned for the covering, often time with shims or other supports to accommodate a modular sizing of the outer frame assembly 11.

It will be understood that various changes in the details, materials and arrangements of parts, or method which have been herein described and illustrated in order to explain the nature of the invention, may be made by those skilled in the art within the principle and scope of the invention as expressed in the appended claims.

What is claimed is:

1. A pleated shutter system for use in covering an opening in a building structure comprising, in combination, an outer frame assembly having a header, footer, left end plate and right end plate, and a plurality of vertically mounted panels pleatedly inserted in such a fashion as to permit opening and closing against the respective left end plate and right end plate, each of the panels having an outer face and an inner face and characterized by the improvement comprising:

said panels being joined by slip fitted lateral knuckle joints and track means engaging guide means extending from ends of the knuckle joints;

a perforated pattern over the substantial entire outer and inner face of each of the panels in which the perforations are spaced a distance at least twice the diameter of the perforation, thereby perforating at least 25% of the panel portion of the closure with a uniform pattern which extends vertically and laterally.

2. The method of forming a pleated shutter system having a plurality of pleated panel members, each panel member having an inner face and an outer face for a building opening in which the panels are joined with slip fitting joints comprising the steps of:

forming a frame having a header, a footer, and end plates both left and right;

providing said frame with tracks for guidingly engaging a portion of the pleated members;

providing rollers at the joints between the pleated members for guidance at the outer portion of the header and footer, and comparable guidance at an inner portion of the header and footer depending upon whether the panel assembly is open or closed; and perforating each of the subject panels with a uniform pattern which substantially covers the entire inner and outer face of the panel;

whereby a pleated enclosure system is formed in which there is a uniformity of access of ventilation through the pleated panel, and uniform penetration of light and visibility through the inner face and the outer face of each panel, and from the outside of the building to the inside.

3. In a shutter panel system for an opening in a wall thereof having a header, a footer, end plates and pleated panels each having a front face joined for pleatably engaging in a central position to cover the opening, and opening into a lateral configuration resembling the drawing of a curtain on a stage, the improvement comprising:

said panels being joined by slip fitted lateral knuckle joints and track means engaging guide means extending from ends of the knuckle joints;

a perforated pattern on each of the panels which pattern is uniform in spacing the perforation each from the other vertically and horizontally over substantially 90% of the front face of each panel.

4. A panel having a front face for use in a pleated shutter system of the type having an outer frame assembly, essentially rectangular, with a header, footer, end plates, and a track system interiorly offset frame to guidingly accept and permit the panels to pleat, then be moved inwardly and outwardly in theater curtain relationship, said panel comprising:

a flat elongate body portion;

a curvilinear knuckle at one lateral edge of said panel, said knuckle having an upper portion and a bottom portion;

a curvilinear knuckle at the opposite edge of said panel, said knuckle having an upper portion and a bottom portion, one of said knuckles being sufficiently larger than the other to slidably and rotatably receive an adjacent like panel thereby forming a knuckle joint;

a roller provided at the upper portion and the bottom portion of each knuckle joint for engagement to the frame while the panel is flexed inwardly and outwardly; and a perforated pattern on said panel;

said perforated panel comprising more than 90% of the front face of such panels;

said perforations, within the aforesaid perforated pattern, reducing the unperforated front face portion by at least 25%, whereby when the aforesaid panels are in the closed relationship interiorly of the frame, light and air will be permitted to pass in both directions, without significantly reducing the strength of such panels to resist heavy wind loads and impact loads.

5. In the panel according to claim 4, said perforation being uniformly spaced from left to right and from top to bottom;

thereby resisting impact forces and heavy wind.

6. In the panel according to claim 5, said perforated patterns comprising a plurality of uniformly spaced holes, in which the spacing between adjacent holes is not less than twice the diameter of each of the perforated holes in the panel.

7. In the panel according to claim 6, said perforations amounting to not less than about ⅛ inch diameter spaced about ¼ inch from each other, whereby the efficient perforating of the subject panel is accomplished while the panel is passed linearly through a perforating press.

* * * * *